US008585559B1

(12) United States Patent
Shannon

(10) Patent No.: US 8,585,559 B1
(45) Date of Patent: Nov. 19, 2013

(54) SKATEBOARD TRAINING APPARATUS AND METHOD

(76) Inventor: James R. Shannon, Central Point, OR (US)

( * ) Notice: Subject to any disclaimer, the term of this patent is extended or adjusted under 35 U.S.C. 154(b) by 211 days.

(21) Appl. No.: 13/105,876

(22) Filed: May 11, 2011

Related U.S. Application Data

(60) Provisional application No. 61/349,824, filed on May 29, 2010.

(51) Int. Cl.
*A63B 69/00* (2006.01)
*A63B 3/00* (2006.01)

(52) U.S. Cl.
USPC ..... 482/41; 482/42; 482/51; 482/146; 482/147

(58) Field of Classification Search
USPC ..... 482/41, 42, 51, 147, 146
See application file for complete search history.

(56) References Cited

U.S. PATENT DOCUMENTS

| | | | | | |
|---|---|---|---|---|---|
| 187,477 | A * | 2/1877 | Medart et al. | 482/41 |
| 412,772 | A * | 10/1889 | Medart | 482/42 |
| 4,415,150 | A * | 11/1983 | Iezza | 482/42 |
| 4,902,000 | A * | 2/1990 | Starks et al. | 482/41 |
| 5,924,960 | A * | 7/1999 | Cohen | 482/51 |
| 6,176,817 | B1 * | 1/2001 | Carey et al. | 482/146 |
| 6,238,320 | B1 * | 5/2001 | Flanagan | 482/41 |
| 6,929,586 | B2 * | 8/2005 | Johnson | 482/41 |
| 7,465,253 | B2 * | 12/2008 | Perry et al. | 482/51 |

* cited by examiner

*Primary Examiner* — Benjamin Layno
(74) *Attorney, Agent, or Firm* — Jerry Haynes Law

(57) ABSTRACT

A skateboard training apparatus includes at least one apparatus base, a skateboard space formed by the apparatus base, a pair of apparatus rails carried by the apparatus base and a skateboard trick practice space formed between the apparatus rails and communicating with the skateboard space. A skateboard training method is also disclosed.

18 Claims, 7 Drawing Sheets

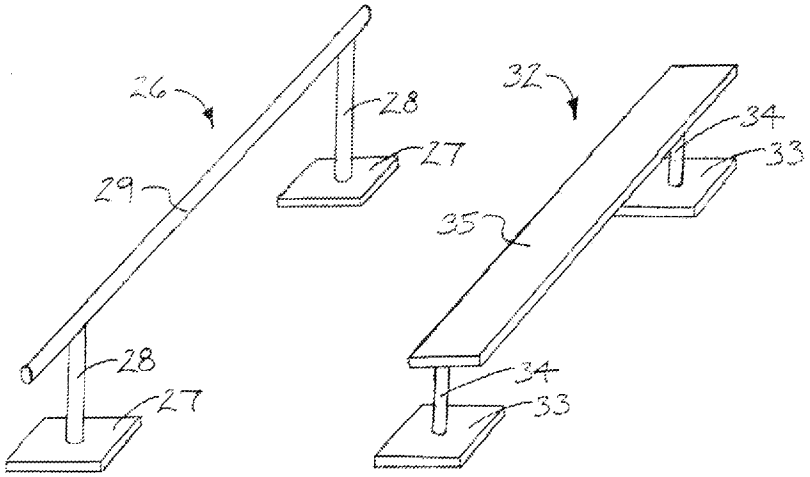
FIG. 7
FIG. 8
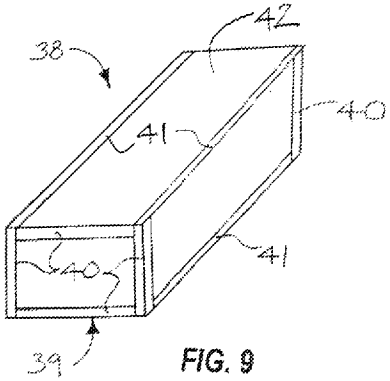
FIG. 9
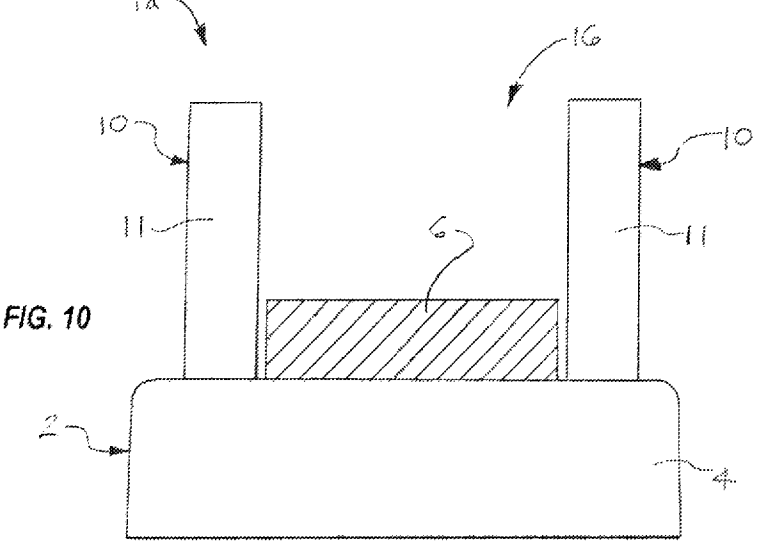
FIG. 10
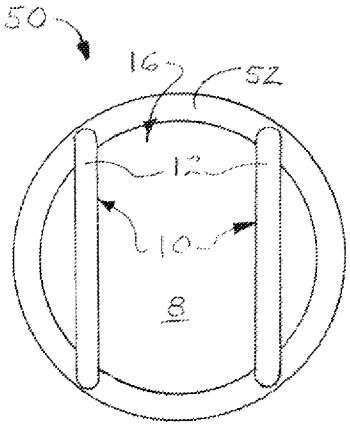
FIG. 11

SKATEBOARD TRAINING APPARATUS AND METHOD

CROSS-REFERENCE TO RELATED APPLICATIONS

This application claims the benefit of U.S. provisional application No. 61/349,824, filed May 29, 2010 and entitled "Method and Apparatus for Skateboard Training", which provisional application is incorporated by reference herein in its entirety.

FIELD OF THE INVENTION

The disclosure is generally directed to skateboarding. More particularly, the disclosure is generally directed to a skateboard training apparatus and method which safely and effectively trains a user in executing various skateboarding maneuvers or "tricks".

BACKGROUND OF THE INVENTION

Skateboarding has enjoyed increasing popularity over the years. Skateboard maneuvers, or "tricks", are popular with many skateboarders. A skateboard trick is typically executed as the skateboarder manipulates the skateboard in some way with the feet and then places the feet back on the skateboard without touching the ground. Many skateboard tricks are complex and require considerable skill to execute correctly and safely.

Traditionally, skateboard tricks are learned by trial and error. However, learning skateboard tricks by trial and error is dangerous since it is common for the rider to fall to the ground with great impact in the event that the skateboard is not landed properly. Moreover, the skateboard may have a tendency to shoot out from under the rider with sufficient force to injure others or damage buildings or vehicles.

Accordingly, a skateboard training apparatus and method which safely and effectively trains a user in executing various skateboard tricks is needed.

SUMMARY OF THE INVENTION

The disclosure is generally directed to a skateboard training apparatus. An illustrative embodiment of the apparatus includes at least one apparatus base, a skateboard space formed by the apparatus base, a pair of apparatus rails carried by the apparatus base and a skateboard trick practice space formed between the apparatus rails and communicating with the skateboard space.

In some embodiments, the skateboard training apparatus may include a base track; an apparatus base rotatably carried by the base track; a skateboard space formed in the apparatus base; a pair of spaced-apart apparatus rails carried by the apparatus base; and a skateboard trick practice space formed between the apparatus rails and communicating with the skateboard space.

The disclosure is further generally directed to skateboard training method. An illustrative embodiment of the method includes providing a skateboard training apparatus having at least one apparatus base, a skateboard space formed by the apparatus base, apparatus rails carried by the apparatus base and a skateboard trick practice space between the apparatus rails; placing a skateboard in the skateboard space; having a skateboarder grip and support himself/herself using his/her arms on the apparatus rails; having the skateboarder stand on the skateboard in the skateboard trick practice space; and having the skateboarder practice skateboard tricks in the skateboard space using the skateboarder's feet.

BRIEF DESCRIPTION OF THE DRAWINGS

The disclosure will now be made, by way of example, with reference to the accompanying drawings, in which:

FIG. 7 is a perspective view of an illustrative embodiment of an auxiliary grind rail assembly;

FIG. 8 is a perspective view of an alternative illustrative embodiment of the auxiliary grind rail assembly;

FIG. 9 is a perspective view of an illustrative embodiment of a guard rail assembly;

FIG. 10 is a side view of an alternative illustrative embodiment of the skateboard training apparatus;

FIG. 11 is a top view of another alternative illustrative embodiment of the skateboard training apparatus;

DETAILED DESCRIPTION

Figure 1:
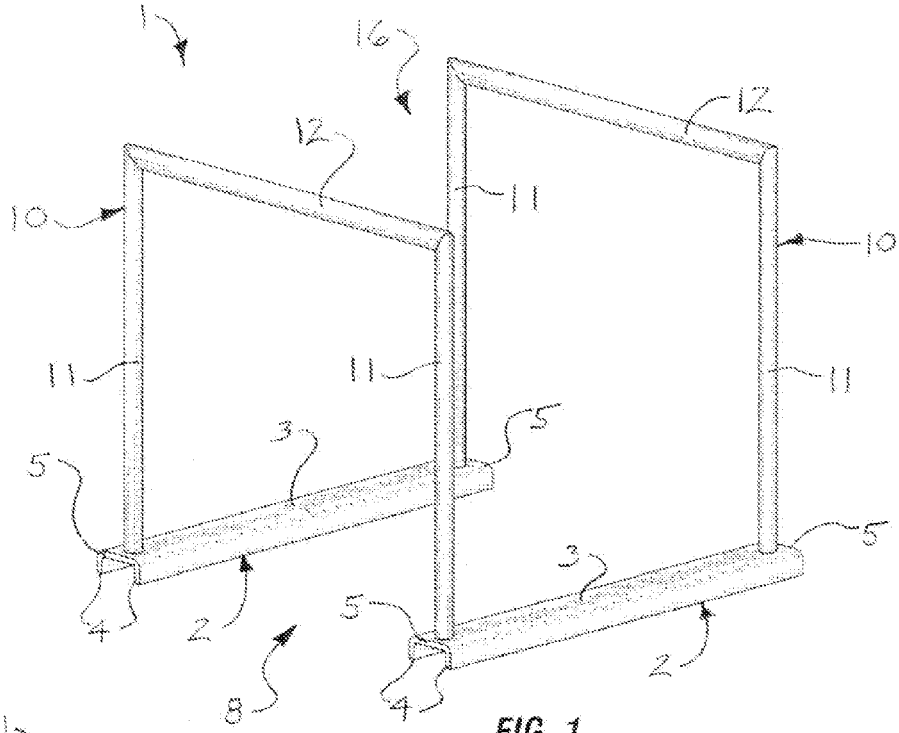
FIG. 1 is a perspective view of an illustrative embodiment of the skateboard training apparatus.
Figure 2:
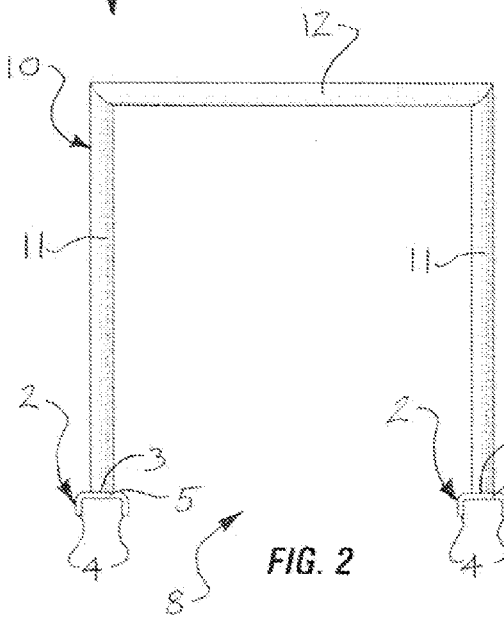
FIG. 2 is a side view of an illustrative embodiment of the skateboard training apparatus.
Figure 3:
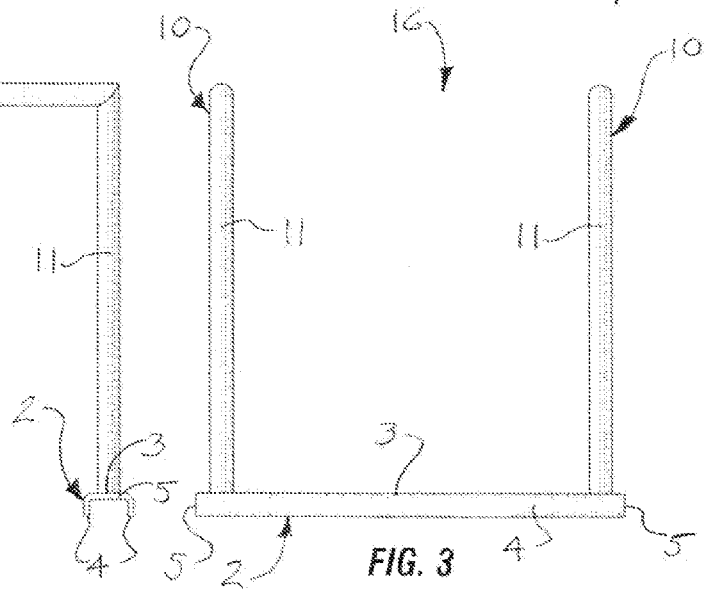
FIG. 3 is a front view of an illustrative embodiment of the skateboard training apparatus.
Figure 4:
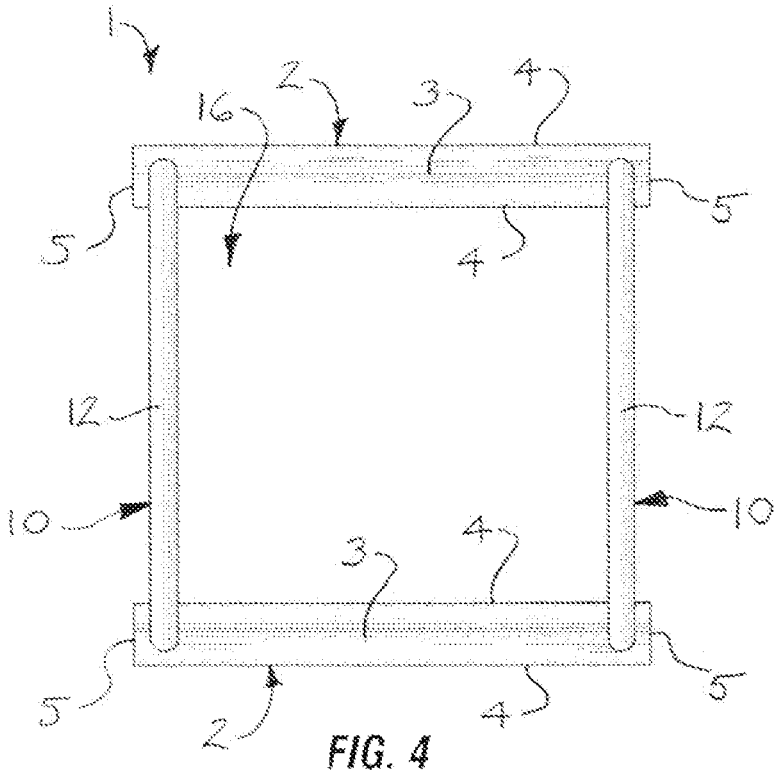
FIG. 4 is top view of an illustrative embodiment of the skateboard training apparatus.
Figure 5:
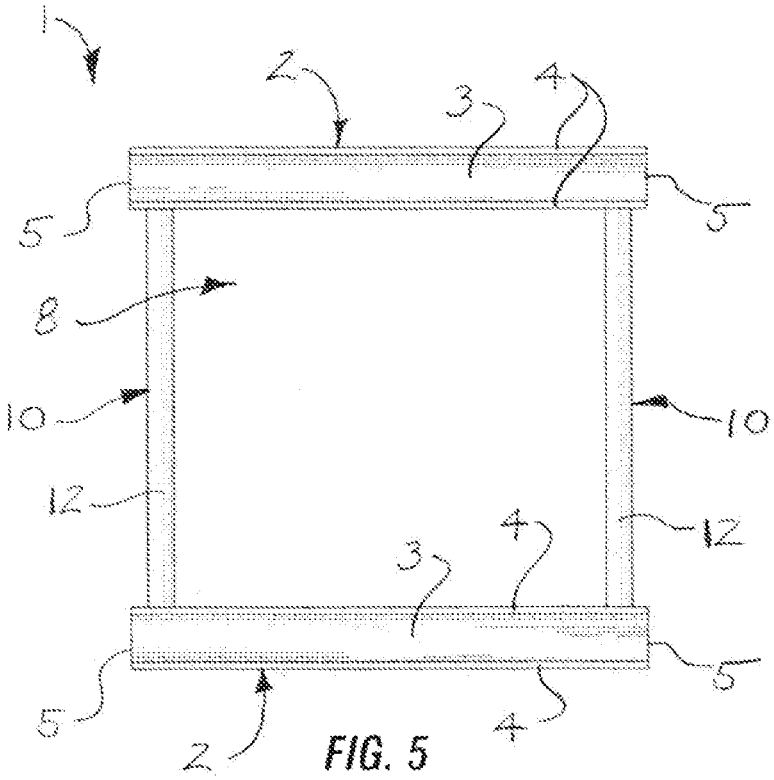
FIG. 5 is a bottom view of an illustrative embodiment of the skateboard training apparatus.

The following detailed description is merely exemplary in nature and is not intended to limit the described embodiments or the application and uses of the described embodiments. As used herein, the word "exemplary" or "illustrative" means "serving as an example, instance, or illustration," Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Referring initially to FIGS. 1-6 of the drawings, an illustrative embodiment of the skateboard training apparatus, hereinafter apparatus, is generally indicated by reference numeral 1. The apparatus 1 may be aluminum or steel, for example and without limitation, and includes at least one apparatus base 2. In some embodiments, the apparatus 1 may include a pair of apparatus bases 2 which may be generally elongated and disposed in generally parallel, spaced-apart relationship to each other, as illustrated. In some embodiments, each apparatus base 2 may be an inverted channel beam with an apparatus base top 3 and spaced-apart apparatus side base flanges 4 extending from the apparatus base top 3. Each apparatus base 2 may have opposite apparatus base ends 5. A skateboard space 8 may be formed by or in the apparatus base 2 or apparatus bases 2 for purposes which will be hereinafter described. In some embodiments, the skateboard space 8 may be formed between the apparatus bases 2, as illustrated. The skateboard space 8 may have a size which is suitable to accommodate a skateboard 20 (FIG. 6) as a skateboarder 22 manipulates the skateboard 20 with his or her feet 23 as will be hereinafter described. In some embodiments, the skateboard space 8 may have a size of at least about 3 square feet.

A pair of spaced-apart apparatus rails 10 may extend from the apparatus base 2 or apparatus bases 2. In some embodiments, each apparatus rail 10 may have a generally inverted. U-shape and may include a vertical rail segment 11 which extends upwardly from a corresponding apparatus base 2 and a horizontal rail segment 12 which connects the vertical rail segments 11. Each vertical rail segment 11 of each apparatus rail 10 may be disposed adjacent to a corresponding apparatus base end 5 of an apparatus base 2. A skateboard trick practice space 16 may be formed between the apparatus rails 10 and communicate with the skateboard space 8. The skateboard trick practice space 16 may have a size which is suitable to accommodate a skateboarder 22 (FIG. 6) as the skateboarder 22 practices skateboard tricks by manipulating the skateboard 20 with his or her feet 23 as will be hereinafter described.

Figure 6:
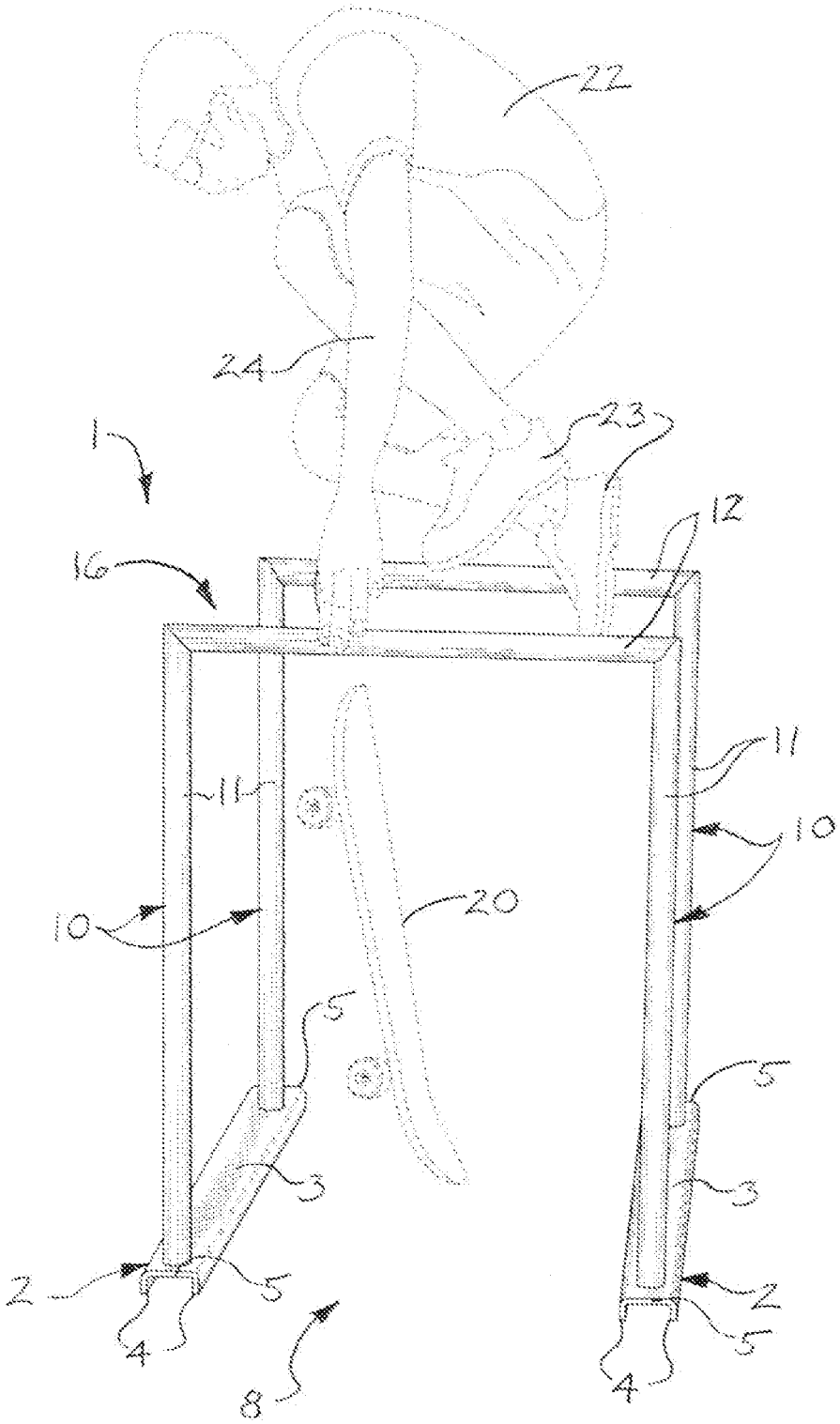
FIG. 6 is a perspective view of an illustrative embodiment of the skateboard training apparatus, with a skateboarder (illustrated in phantom) practicing a trick on a skateboard (also illustrated in phantom) in exemplary application of the skateboard training apparatus.

As illustrated in FIG. 6, in exemplary application, the apparatus 1 enables a skateboarder 22 to safely and effectively learn or practice various skateboarding maneuvers or tricks while preventing or minimizing the risk of injury to the skateboarder 22. The apparatus 1 may enable the skateboarder 22 to learn and fine-tune skateboarding tricks in less time and with less injuries than with traditional methods. Accordingly, the skateboard 20 is initially placed on the ground (not illustrated) in the skateboard space 8 between the apparatus bases 2. The skateboarder 22 then places his or her feet 23 on the skateboard 20, stands in the skateboard trick practice space 16 and grips the horizontal rail segments 12 of the respective apparatus rails 10. As the skateboarder 22 supports himself or herself with his or her arms 24 on the apparatus rails 10, the skateboarder 22 can then manipulate the skateboard 20 with the feet 23 to perform any of various tricks such as ollies, kickflips, heelflips, hardflips, pop shivots, rotational tricks and any variations of tricks as well as their nollie counterparts, for example and without limitation. Therefore, the apparatus rails 10 enable the skateboarder 22 to support himself or herself while performing the tricks without the fear of inadvertently falling to the ground in the event of improper execution of the trick. In the event that he or she inadvertently fumbles a trick, the skateboarder 22 can simply support himself or herself on the apparatus rails 10 using his or her arms 24 such that the skateboarder 22 does not fall to the ground and the skateboard 20 remains beneath the skateboarder 22 in the skateboard space 8. As the skill of the skateboarder 22 in properly executing the tricks progresses, the skateboarder 22 can try to perform the tricks without the aid of the apparatus 1.

Referring next to FIG. 10 of the drawings, an alternative illustrative embodiment of the skateboard training apparatus is generally indicated by reference numeral 1*a*. The apparatus 1*a* may have a design which is similar to that of the apparatus 1 heretofore described with respect to FIGS. 1-6. In the apparatus 1*a*, the apparatus base 2 may have a selected height. A grind rail 6 may be provided on one or both of the apparatus bases 2. Accordingly, a skateboarder 22 (FIG. 6) may use the grind rail 6 to practice and build confidence in "locking into" and properly executing grind maneuvers with the skateboard 20. In various embodiments, the grind rail 6 can be formed integrally with the apparatus base 2 or attached to the apparatus base 2 using fasteners (not illustrated) and/or other suitable attachment technique known by those skilled in the art.

Figure 14:
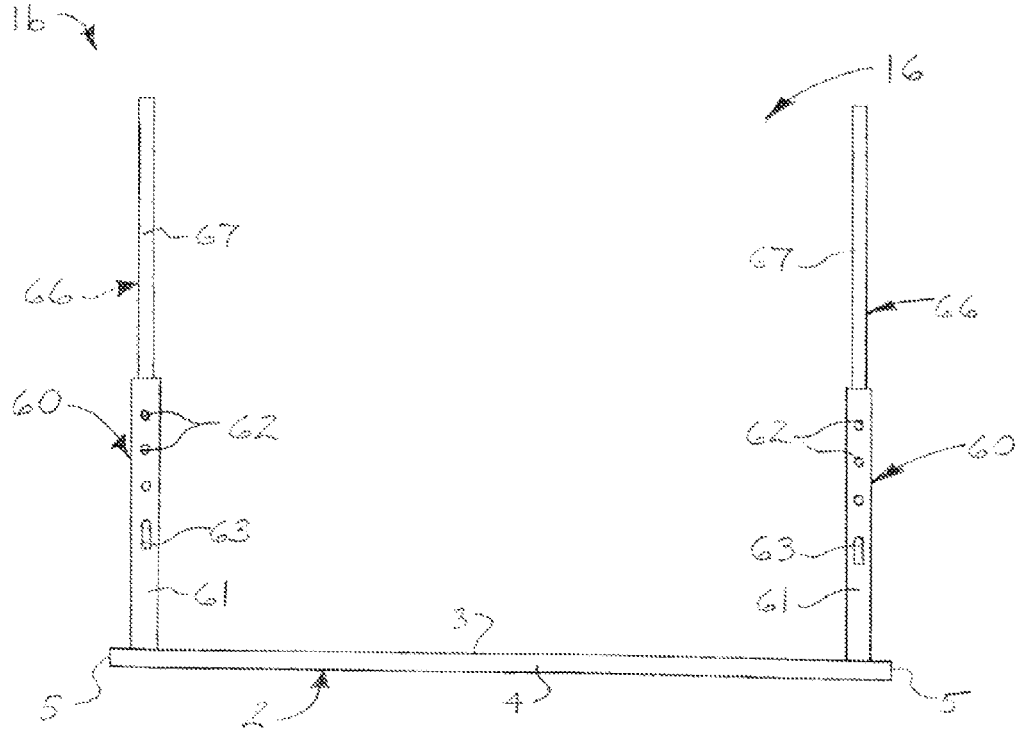
FIG. 14 is a side view of an illustrative vertically-adjustable embodiment of the skateboard training apparatus.
Figure 15:
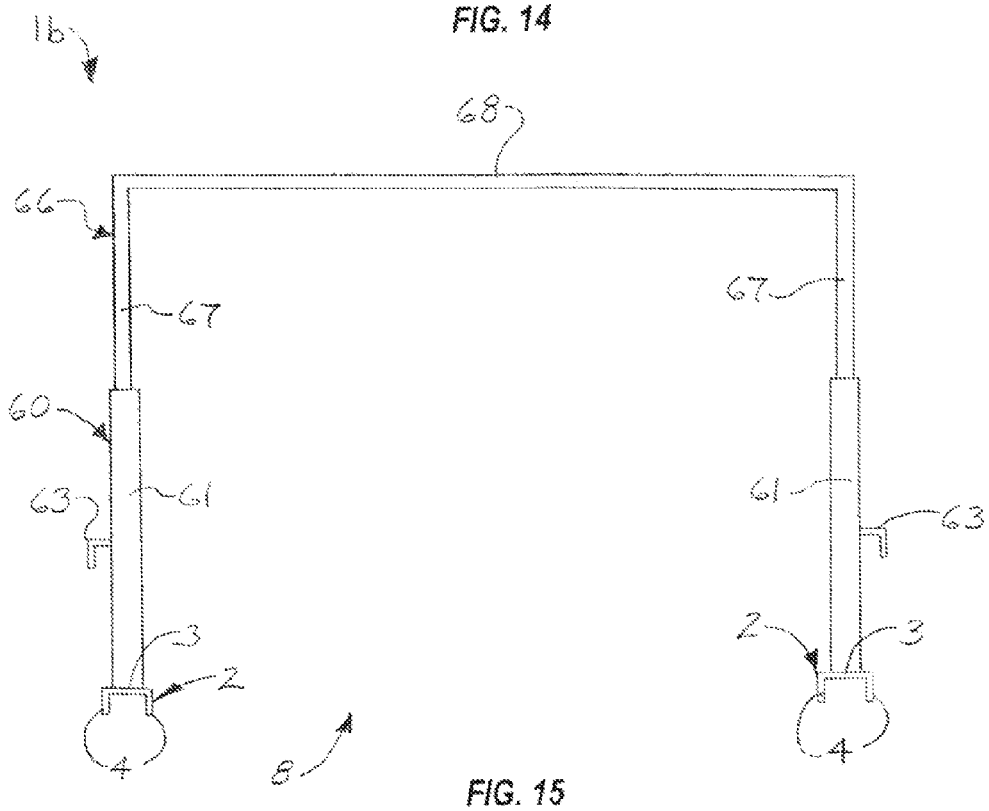
FIG. 15 is a side view of the skateboard training apparatus illustrated in FIG. 14.

Referring next to FIGS. 14 and 15 of the drawings, another alternative illustrative embodiment of the skateboard training apparatus 1*b* includes a pair of height-adjustable apparatus rails 60. Each apparatus rail 60 may include a pair of rail bases 61 which extend upwardly from the respective apparatus bases 2, as illustrated in FIG. 15. Multiple vertically-spaced pin openings 62 (FIG. 14) may be provided in each rail base 61. A rail insert 66 is vertically adjustable with respect to the rail bases 61. The rail insert 66 may include a pair of generally elongated, spaced-apart vertical rail segments 67 which are telescopically inserted in the respective rail bases 61 and a horizontal rail segment 68 which connects the vertical rail segments 67. Accordingly, the rail insert 66 can be deployed at a selected height depending on the preferences of the practicing skateboarder 22 (FIG. 6) by extending a lock pin 63 through one of the pin openings 62 in the corresponding rail base 61 and through a registering pin opening (not illustrated) in the corresponding vertical rail segment 67 of the rail insert 66 to lock the rail insert 66 at the selected height. The practicing skateboarder 22 grips the horizontal rail segments 68 on the rail inserts 66 of the respective apparatus rails 60 to practice execution of the skateboard tricks with his or her feet 23 as was heretofore described with respect to the apparatus 1 in FIG. 6.

Referring next to FIG. 7 of the drawings, an auxiliary grind rail assembly 26 may include a pair of spaced-apart assembly bases 27. A pair of rail supports 28 may be upward-standing from the respective assembly bases 27. A round grind rail 29 may be supported by the rail supports 28. Accordingly, a practicing skateboarder 22 (FIG. 6) can use the grind rail 29 of the auxiliary grind rail assembly 26 to practice and build confidence in locking into and properly executing grind maneuvers using the skateboard 20 on the grind rail 29.

Referring next to FIG. 8 of the drawings, an alternative illustrative embodiment of an auxiliary grind rail assembly 32 may include a pair of spaced-apart assembly bases 33. A pair of rail supports 34 may be upward-standing from the respective assembly bases 33. A rectangular grind rail 35 may be supported by the rail supports 34. Accordingly, a practicing skateboarder 22 (FIG. 6) can use the grind rail 35 of the auxiliary grind rail assembly 32 to practice and build confidence in locking into and properly executing grind maneuvers using the skateboard 20 on the grind rail 35.

Referring next to FIG. 9 of the drawings, an illustrative embodiment of a grind rail assembly 38 is illustrated. The grind rail assembly 38 may include a grind rail assembly frame 39 which may have a generally elongated, box-shaped configuration. The grind rail assembly frame 39 may include a pair of spaced-apart rectangular end frame members 40 and multiple side frame members 41 connecting the end frame members 40. An assembly top panel 42, which may be plywood, for example and without limitation, may be supported between a pair of the side frame members 41 of the grind rail assembly frame 39. Accordingly, a practicing skateboarder 22 (FIG. 6) can use one of the side frame members 41 next to the assembly top panel 42 to practice and build confidence in locking into and properly executing grind maneuvers using the skateboard 20 on the side frame member 41.

Figure 13:
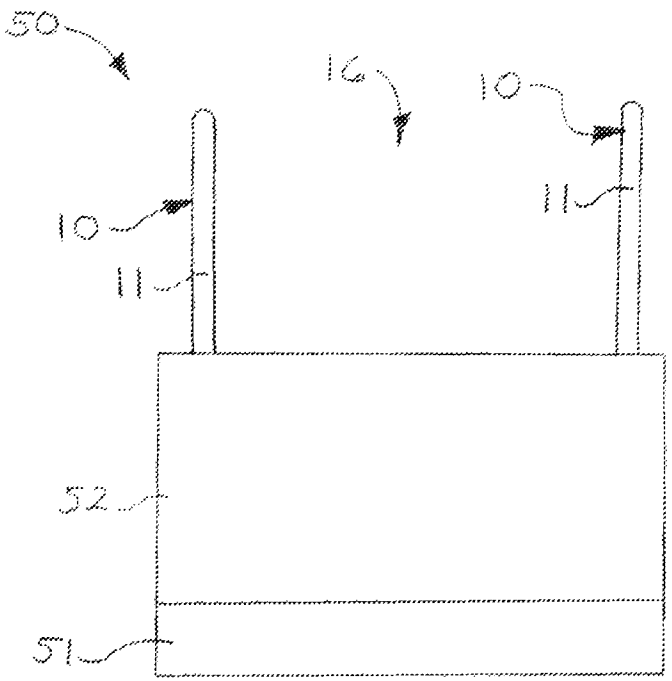
FIG. 13 is a front view of the skateboard training apparatus illustrated in FIG. 11.
Figure 12:
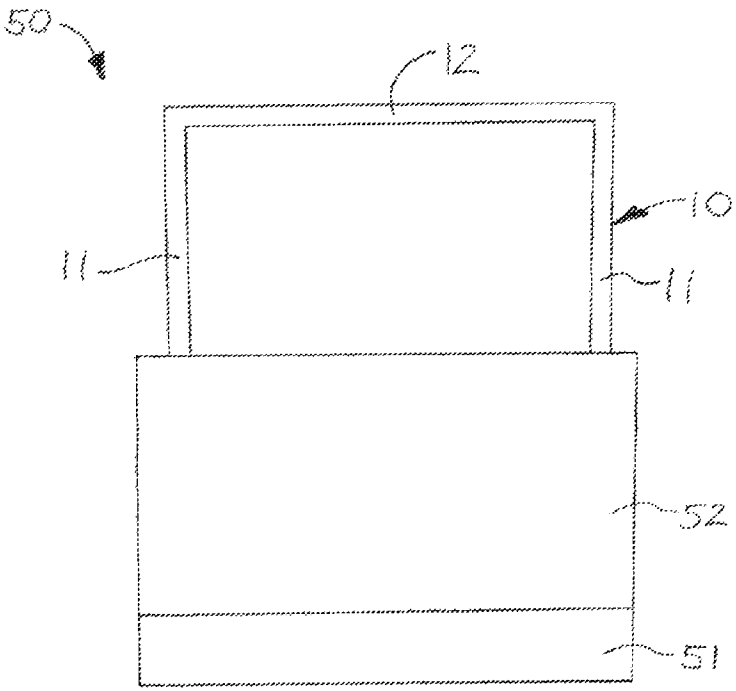
FIG. 12 is a side view of the skateboard training apparatus illustrated in FIG. 11.

Referring next to FIGS. 11-13 of the drawings, another alternative illustrative embodiment of the skateboard training apparatus is generally indicated by reference numeral 50. As illustrated in FIGS. 12 and 13, the apparatus 50 may include around, annular or circular base track 51. An apparatus base 52 may be mounted on the base track 51 in such a manner that the apparatus base 52 is rotatable with respect to the base track 51. In some embodiments, bearings (not illustrated) may be inserted between the base track 51 and the apparatus base 52 to reduce friction as the apparatus base 52 rotates with respect to the base track 51. A pair of apparatus rails 10 may be upward-standing from the apparatus base 52. Accordingly, a skateboarder 22 (FIG. 6) can place a skateboard 20 in the middle of the base track 51 and support himself or herself on the apparatus rails 10 to practice skateboard tricks involving rotation as the apparatus base 52 rotates with respect to the base track 51.

Figure 16:
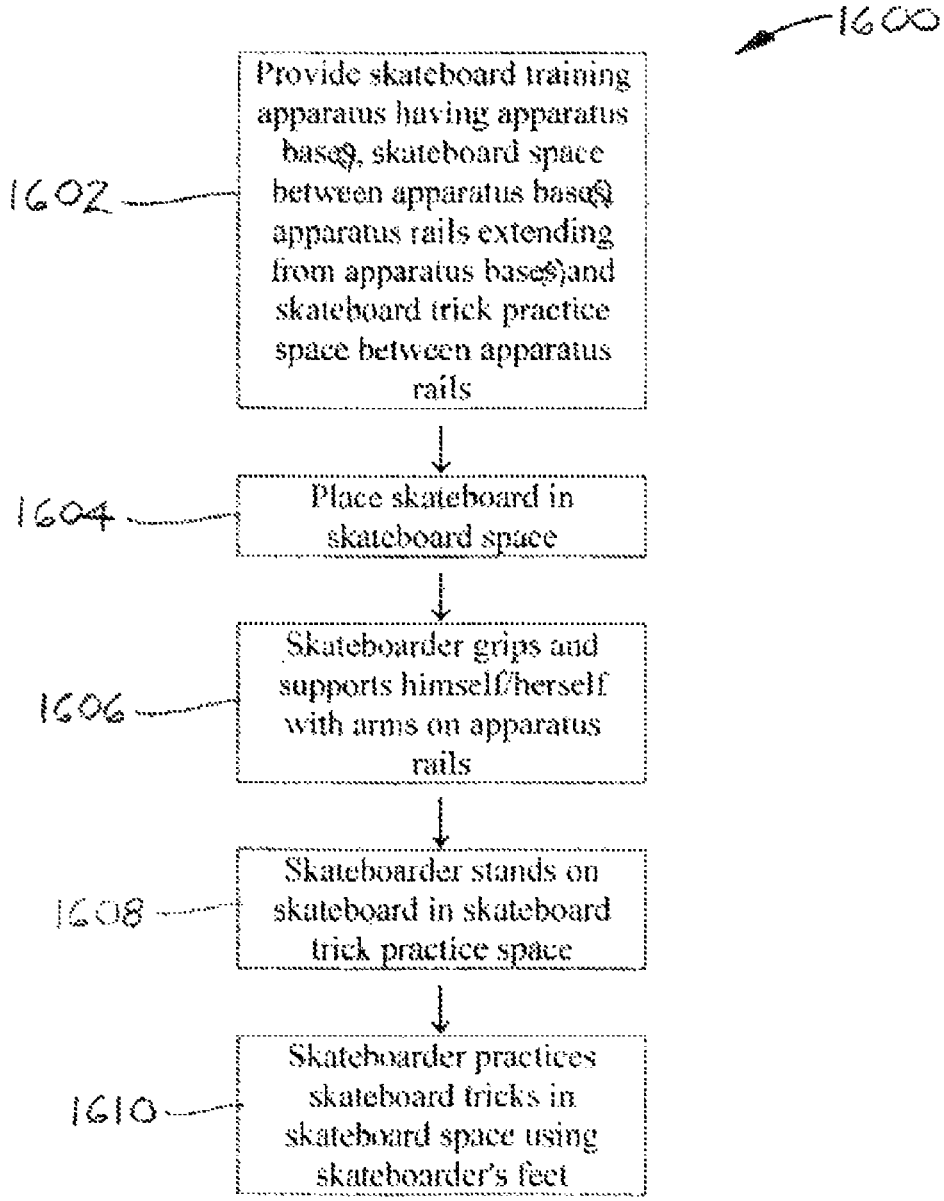
FIG. 16 is a flow diagram of an illustrative embodiment of the skateboard training method.

Referring next to FIG. 16 of the drawings, a flow diagram 1600 of an illustrative embodiment of a skateboard training method is illustrated. In block 1602, a skateboard training apparatus having at least one apparatus base, a skateboard space formed by the apparatus base or bases, apparatus rails extending from the apparatus base or apparatus bases and a skateboard trick practice space between the apparatus rails is provided. In various applications, the skateboard training apparatus may have a design which is the same as or similar to the apparatus 1 (FIGS. 1-6), the apparatus 1*a* (FIG. 10), the apparatus 1*b* (FIGS. 14 and 15) or the apparatus 50 (FIGS. 11-13). In block 1604, a skateboard is placed in the skateboard space of the apparatus. In block 1606, a skateboarder grips and supports himself or herself using his or her arms on the apparatus rails. In block 1608, the skateboarder stands on the skateboard in the skateboard trick practice space of the apparatus. In block 1610, the skateboarder practices the skateboard tricks in the skateboard space using the skateboarder's feet. The skateboard tricks may include any of a variety of skateboard tricks which are known by those skilled in the art including but not limited to ollies, kickflips, heelflips, hardflips, pop shivots, rotational tricks and any variations of tricks as well as their nollie counterparts. In some applications, the skateboarder may practice grind maneuvers with the skateboard on the grind rail 6 of the apparatus 1*a* which is illustrated in FIG. 10.

It will be appreciated by those skilled in the art that a variety of embodiments of the skateboard training apparatus are possible depending on the types of skateboard tricks or maneuvers which a skateboarder desires to practice in a safe and effective manner. For example, referring again to FIG. 10, in some embodiments of the apparatus 1*a*, a grind rail 6 may be attached to one or both of the apparatus bases 2 to enable the skateboarder to practice grinding maneuvers. Other embodiments may include heightening of all or a portion of the apparatus bases to create a built-in fun box or a fun box with a built-in piece of tubing so that the possibility of locking into various obstacles is built into the apparatus. Fun box variations may include bolt-on or freestanding accessories. Additionally, the apparatus can be appropriately sized for younger skateboarders who are being introduced to skateboarding at an early age. Likewise, the vertically-adjustable apparatus rails 60 of the apparatus 1*b* which was heretofore described with respect to FIGS. 14 and 15 may be adjusted to accommodate growth spurts and allow a preferred rail height to be achieved. Similarly, the connection between each apparatus base and each apparatus rail can be made continuously-adjustable or incrementally-adjustable by such means as bolted, clamped or press-fitted attachments, for example and without limitation.

While various illustrative embodiments have been described above, it will be recognized and understood that various modifications can be made and the appended claims are intended to cover all such modifications which may fall within the spirit and scope of the disclosure.

What is claimed is:

1. A skateboard training apparatus, comprising:

a pair of spaced-apart apparatus bases;

a skateboard space formed by the apparatus bases, the skateboard space unobstructed between the apparatus bases;

a pair of apparatus rails carried by the apparatus bases; and a skateboard trick practice space formed between the apparatus rails and communicating with the skateboard space.

2. The skateboard training apparatus of claim 1 wherein each of the apparatus bases has a generally inverted U-shaped cross-section.

3. The skateboard training apparatus of claim 1 wherein the apparatus rails connect the apparatus bases to each other.

4. The skateboard training apparatus of claim 3 wherein each of the apparatus rails comprises a pair of vertical rail segments carried by the respective apparatus bases and a horizontal rail segment carried by the vertical rail segments.

5. The skateboard training apparatus of claim 1 wherein the skateboard space has an area of at least about 3 square feet.

6. The skateboard training apparatus of claim 1 wherein each of the apparatus rails comprises a pair of rail bases carried by the respective apparatus bases and a rail insert telescopically inserted in the rail bases, respectively.

7. The skateboard training apparatus of claim 6 wherein the rail insert comprises a pair of spaced-apart vertical rail segments telescopically inserted in the respective rail bases and a horizontal rail segment carried by the vertical rail segments.

8. The skateboard training apparatus of claim 7 further comprising a plurality of spaced-apart pin openings in each of the rail bases and a lock pin extending through one of the pin openings and engaging the corresponding vertical rail segment.

9. The skateboard training apparatus of claim 1 further comprising a grind rail carried by at least one of the apparatus bases.

10. The skateboard training apparatus of claim 1 wherein the apparatus bases comprises a pair of generally elongated, parallel, spaced-apart apparatus bases each having apparatus base ends and the apparatus rails are carried by the apparatus bases generally adjacent to the apparatus base ends.

11. A skateboard training apparatus, comprising:

a base track;

an apparatus base rotatably carried by the base track;

a skateboard space formed in the apparatus base;

a pair of spaced-apart apparatus rails carried by the apparatus base; and a skateboard trick practice space formed between the apparatus rails and communicating with the skateboard space.

12. The skateboard training apparatus of claim 11 wherein each of the apparatus rails comprises a pair of spaced-apart vertical rail segments carried by the apparatus base and a horizontal rail segment carried by the vertical rail segments.

13. A skateboard training method, comprising:

providing a skateboard training apparatus having a base track, at least one apparatus base rotatably carried by the base track, a skateboard space formed by the apparatus base, apparatus rails carried by the apparatus base and a skateboard trick practice space between the apparatus rails;

placing a skateboard in the skateboard space;

having a skateboarder grip and support himself/herself using his/her arms on the apparatus rails;

having the skateboarder stand on the skateboard in the skateboard trick practice space; and having the skateboarder practice skateboard tricks in the skateboard space using the skateboarder's feet.

14. The skateboard training method of claim 13 wherein providing a skateboard training apparatus comprises providing a skateboard training apparatus having a pair of spaced-apart apparatus bases with the skateboard space formed between the apparatus bases.

15. The skateboard training method of claim 13 further comprising adjusting the heights of the apparatus rails on the skateboard training apparatus.

16. The skateboard training method of claim 13 wherein having the skateboarder practice skateboard tricks comprises having the skateboarder practice at least one of ollies, kickflips, heelflips, hardflips, pop shivots and rotational tricks.

17. The skateboard training method of claim 13 wherein providing a skateboard training apparatus having a skateboard space formed by the apparatus base comprises providing a skateboard training apparatus having a skateboard space with an area of at least about 3 square feet.

18. The skateboard training method of claim 13 wherein providing a skateboard training apparatus comprises providing a skateboard training apparatus having at least one grind rail on the at least one apparatus base, and further comprising having the skateboarder practice grind maneuvers with the skateboard on the grind rail.

* * * * *